US007767921B2

(12) United States Patent
Schloms et al.

(10) Patent No.: US 7,767,921 B2
(45) Date of Patent: Aug. 3, 2010

(54) CIRCUIT BREAKER FOR ELECTRICAL POWER LEADS OF MOTOR VEHICLES

(75) Inventors: Martin Schloms, Aachen (DE); Franz-Josef Lietz, Oberhausen-Lirich (DE); Uwe Glasenapp, Schopfheim (DE)

(73) Assignee: Auto Kabel Managementgesellschaft mbH, Hausen i.W. (DE)

( * ) Notice: Subject to any disclaimer, the term of this patent is extended or adjusted under 35 U.S.C. 154(b) by 185 days.

(21) Appl. No.: 11/910,496

(22) PCT Filed: Mar. 22, 2006

(86) PCT No.: PCT/EP2006/060943

§ 371 (c)(1),
(2), (4) Date: Dec. 3, 2007

(87) PCT Pub. No.: WO2006/106042

PCT Pub. Date: Oct. 12, 2006

(65) Prior Publication Data

US 2008/0197001 A1 Aug. 21, 2008

(30) Foreign Application Priority Data

Apr. 8, 2005 (EP) ..... 05007772

(51) Int. Cl.
*H01H 1/06* (2006.01)

(52) U.S. Cl. ..... 200/279; 200/275; 200/253.1

(58) Field of Classification Search ..... 200/279, 200/61.44, 239, 248, 275, 253.1, 244
See application file for complete search history.

(56) References Cited

U.S. PATENT DOCUMENTS

| | | | | |
|---|---|---|---|---|
| 4,211,904 | A * | 7/1980 | Karrenbauer | 218/59 |
| 4,934,964 | A * | 6/1990 | Mazelle | 439/843 |
| 5,391,847 | A * | 2/1995 | Gallone | 200/244 |
| 5,725,399 | A | 3/1998 | Albiez et al. | 439/762 |

FOREIGN PATENT DOCUMENTS

FR 2745123 8/1997

OTHER PUBLICATIONS

International Search Report, International Application No. PCT/EP2006/060943; Date of Mailing Jun. 16, 2006.
Abstract (English) of foreign patent document FR 2745123. Abstract provided by esp@cenet database—worldwide.

* cited by examiner

*Primary Examiner*—Renee S Luebke
*Assistant Examiner*—Vanessa Girardi
(74) *Attorney, Agent, or Firm*—Sunstein Kann Murphy & Timbers LLP

(57) ABSTRACT

The invention relates to a circuit breaker for electric supply lines, in particular energy lines or battery cables of motor vehicles. Said circuit breaker comprises a first connection element (2) and a second connection element (4), the current path running between the first connection element (2) and the second connection element (4), when the circuit breaker (6) is in a conductive state. The aim of the invention is to provide a cost-effective, fail-safe circuit breaker. To achieve this, the first connection element (2) comprises a cavity (8) and the second connection element (4) is configured from an electrically conductive flat part and the second connection element (4) has a projection (10) that corresponds to the shape of the cavity (8), in such a way that in the conductive state of the circuit breaker (1), the projection (10) rests in the cavity (8) in a non-positive fit.

13 Claims, 6 Drawing Sheets

CIRCUIT BREAKER FOR ELECTRICAL POWER LEADS OF MOTOR VEHICLES

TECHNICAL FIELD

The application in general relates to a circuit breaker for electrical power leads, especially energy supply lines or battery cables of motor vehicles, with a first connection element and a second connection element, in which when the circuit breaker is in conducting state a current path runs between the first connection element and the second connection element.

BACKGROUND ART

Circuit breakers for motor vehicles are sufficiently well-known. For example, DE 197 12 544 A1 discloses a circuit breaker and circuit breaker wiring. In order to guarantee safe interruption of contact in the event of a serious collision involving vehicles, DE 197 12 544 A1 suggests cutting off the supply of power by mechanical cutting of a fuse. However, the result of this cutting of the fuse is that after a serious collision the circuit breaker is destroyed and has to be replaced.

DE 197 12 544 A1 also suggests the use of a pressure block to push a movable contact onto a fixed contact and thus maintain conductivity. Electromagnetic coils can be used to cancel the holding status by opening the breaker. The disadvantage of such an arrangement is that, for example, external forces which are not attributable to a collision may exceed the strength of the holding element and thus cause a break in the circuit. This leads to undesirable operational interruptions.

DE 196 06 447 A1 suggests a circuit breaker for vehicle battery cables. In this circuit breaker a piston is inserted into a hollow cylinder of a recess and the current path is thus obtained. In the event of a fault, the piston is forced out of the hollow cylinder by means of a percussion cap. The current path is interrupted by the forcing out of the piston.

The piston can be prevented from jumping back into the original position by an annular shoulder in the hollow cylinder. This very precise circuit breaker arrangement has the disadvantage that it is expensive to manufacture. Therefore it is only worthwhile for use in high-priced vehicles.

Finally, EP 1 469 564 A1 discloses a pyrotechnical battery pole separation element. In this separation element, a one-piece conductor arrangement is separated at a separation point by means of a separation element arranged on a separation piston if there is an accident. The separating piston is driven by a pyrotechnical drive. Here, too, it is disadvantageous that when triggered, the one-piece conductor is destroyed and thereafter must be replaced. This is cost-intensive.

On the basis of the aforementioned disadvantages, the invention was based on the problem of providing a circuit breaker for electrical power leads which is, firstly, economical to manufacture, and secondly, guarantees faultless operation.

SUMMARY OF THE INVENTION

This problem was solved according to the application by the fact that the first connection element has a recess, that the second connection element is formed from an electrically-conductive flat part and that the second connection element has a projection corresponding with the recess, in such a way that when the circuit breaker is in conducting state the projection is held in the recess by force closure.

Since at least the second connection element is made from flat parts, manufacture is extremely cheap. But the first connection element may also be made from a flat conductor, which further reduces production costs.

The flat parts can easily be shaped and thus both a recess and a projection can be formed in the connection elements with little technical effort. The two connection elements can be mechanically connected to each other by means of the force closure (friction locking) connection between projection and recess. This produces a current path. The force which must be applied to break this connection can be adjusted by the design of the recess and of the projection. Preferably the projection is arranged in the recess by means of a press fit. A direct clamp connection between projection and recess is preferable. A conical press fit is especially preferred. The recess and/or the projection can be tapered in shape. It is preferable if the pot tapers starting from the flat part.

The connection elements can be made especially economically if at least one flat part is made from sheet metal. Sheets of electrically-conductive materials of various thicknesses are cheap and are easy to work. Extruded strips can also be used to produce the flat parts.

It is preferable for the flat parts to be formed out of the sheet metal using separation methods. Especially suitable separation methods are stamping, laser cutting, sawing or other non-cutting or cutting separation methods.

The recess can be stamped, cut or drilled out of the connection element.

An especially stable connection between the connection elements is guaranteed by the fact that the recess has a collar. This collar can for example be created when the recess is stamped out of the connection element. The collar can also be made by inserting a mandrel into the recess, after this has been formed. The collar can be formed so that a good fit is created between projection and recess.

The circuit breaker can be manufactured especially economically if the projection is formed in one piece from the flat part. Preferably, the projection can be drawn out of the flat part. This can be done for example by means of stretch-forming or deep-drawing or by means of bending. At the same time a stamp can be guided into the flat part in such a way that the flat part forms the projection. It is, however, also possible for the projection to be attached to the flat part using bonding and/or force closing (frictional joining).

It is preferable for the projection to be a deep-drawn pot corresponding with the recess. It is especially preferable to manufacture the circuit breaker very cheaply and quickly when the projection is not drawn out of the flat part until the joining of the first connection element with the second connection element. Then for example the first connection element can be laid on the second connection element, and a stamp can simultaneously form the projection and drive into the recess in order to join the connection elements together.

A further advantageous embodiment is produced when a separation unit is provided on the first connection element. The separation unit can have an accessory drive by means of which the connection elements can be separated from each other. A pyrotechnic igniter is preferred as accessory drive. This separation unit can be provided on the first connection element in such a way that it can separate the frictional connection between the first connection element and the second connection element. For example, by firing the igniter, a pressure can be generated which presses the projection out of the recess and thus effects a separation of the connection elements.

Especially certain separation is guaranteed when a pin is provided in the separation unit and this pin is accelerated in the direction of the projection and thus breaks the force closure. By accelerating the pin, a greater impetus can be imparted to the projection, so that the press connection is broken with greater certainty.

A further aspect of the application is a method for manufacturing a circuit breaker for motor vehicles by forming a first connection element and forming a second connection element made from an electrically conducting flat part, characterised by the forming of a recess in the first connection element, the forming of a projection corresponding with the recess in the second connection element, and connecting the first connection element with the second connection element by force closure (frictional connection) of projection and recess.

The circuit breaker can be manufactured especially advantageously and cheaply if the projection is not formed until the connection elements are joined together. This can occur for example by the fact that a mandrel drives the material of the second connection element into the recess of the first connection element and thus forms a projection in the second connection element, which is in a press connection with the first connection element.

BRIEF DESCRIPTION OF THE DRAWINGS

The application will next be explained in more detail with the aid of a drawing showing embodiments.

In the drawing show.

DETAILED DESCRIPTION OF SPECIFIC EMBODIMENTS

Figure 1B:
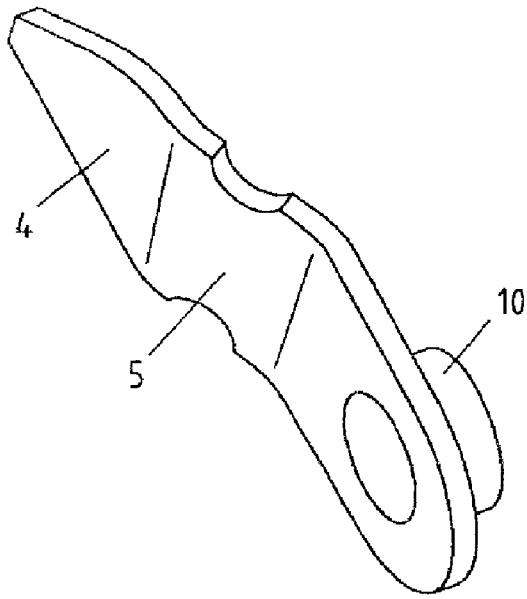
FIG. 1B a second connection element.
Figure 1A:
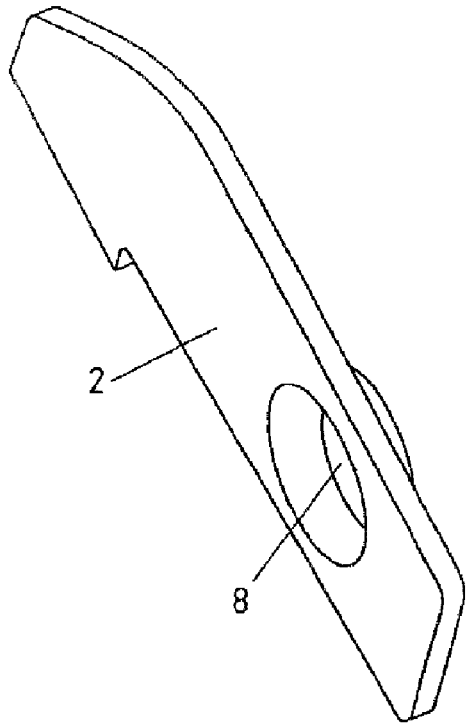
FIG. 1A a first connection element.

FIG. 1A shows a first connection element 2 with a recess 8. The first connection element 2 can be a flat part made from sheet metal. To manufacture the flat part, this can be stamped, cut or otherwise produced from a sheet of metal. The recess 8 can be stamped out of the flat part. It is also possible to cut or drill the recess out of the flat part.

FIG. 1B shows a second connection element 4. This second connection element 4 can, like the first connection element 2, be a flat part formed out of a sheet of metal. A projection 10 is provided on the second connection element 4. The projection 10 can be made in the form of a pot. The projection 10 is in particular formed in one piece with the flat part. To manufacture the projection 10, this can be deep-drawn out of the flat part. The projection 10 can also be welded or soldered onto the flat part.

One of the connection elements 2, 4 can have a constriction 5. The constriction 5 can serve as a predetermined break point. When the connection is blasted off, one connection element can be more easily deformed along the constriction 5, with the result that the projection 10 is more easily released from the recess 8.

In particular, the second flat part 4 can be laid on the first connection element 2 in the raw state and a mandrel (not shown) can press the flat part into the recess 8, so that the projection 10 is formed and at the same time the connection elements 2, 4 can be frictionally connected.

Figure 1C:
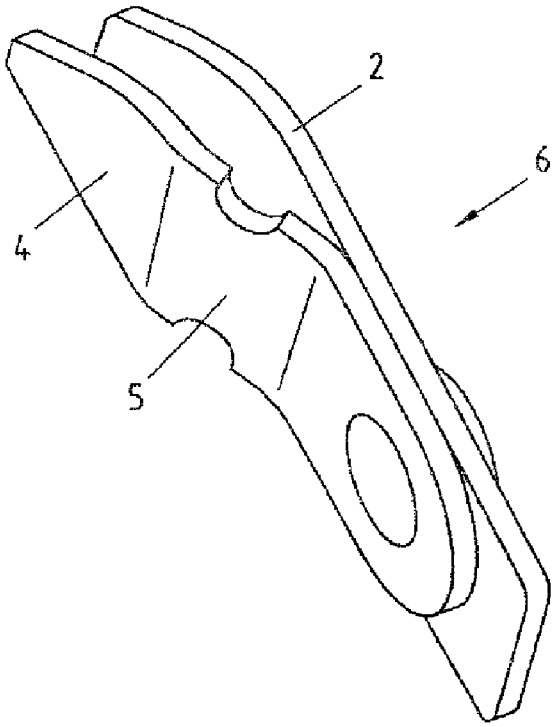
FIG. 1C a circuit breaker with joined connection elements.

FIG. 1C shows a circuit breaker 6 in which the first connection element 2 is joined to the second connection element 4. For preference, a direct clamp connection is provided. This can for example be a frictional press connection. In the state shown, a current path is formed between connection element 2 and connection element 4.

The connection between connection element 2 and connection element 4 via the projection 10 may take various forms. If recess 8 and projection 10 are conical, a conical press fit can be produced.

Figure 2:
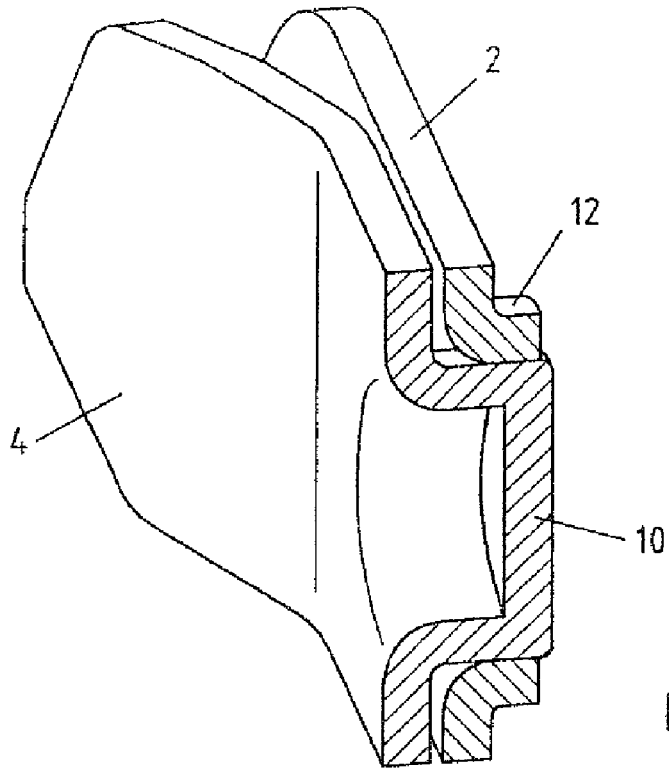
FIG. 2 a first embodiment of a joining of the connection elements.

FIG. 2 shows a first connection of the connection elements 2, 4 in which a collar 12 runs along the recess 8 of the first connection element 2. The seat-engaging surface of the projection 10 in the recess 8 is enlarged by the collar 12, guaranteeing a better frictional connection. The collar 12 can be made as follows: after the recess 8 has been formed, a mandrel engages in this and presses further material of the flat part out of the recess.

Figure 3:
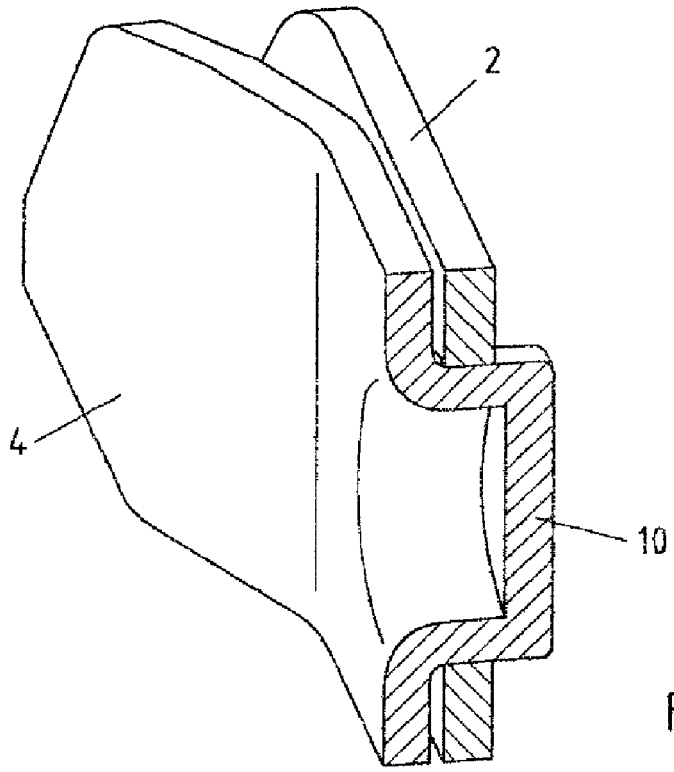
FIG. 3 a second embodiment of a joining of the connection elements.

FIG. 3 shows one possible embodiment of the connection element 2 in which the recess 8 has no collar 12. Such a connection element 2 can be manufactured cheaply, but has a weaker force closure, since the projection 10 has a smaller seat-engaging surface on connection element 2.

Figure 4:
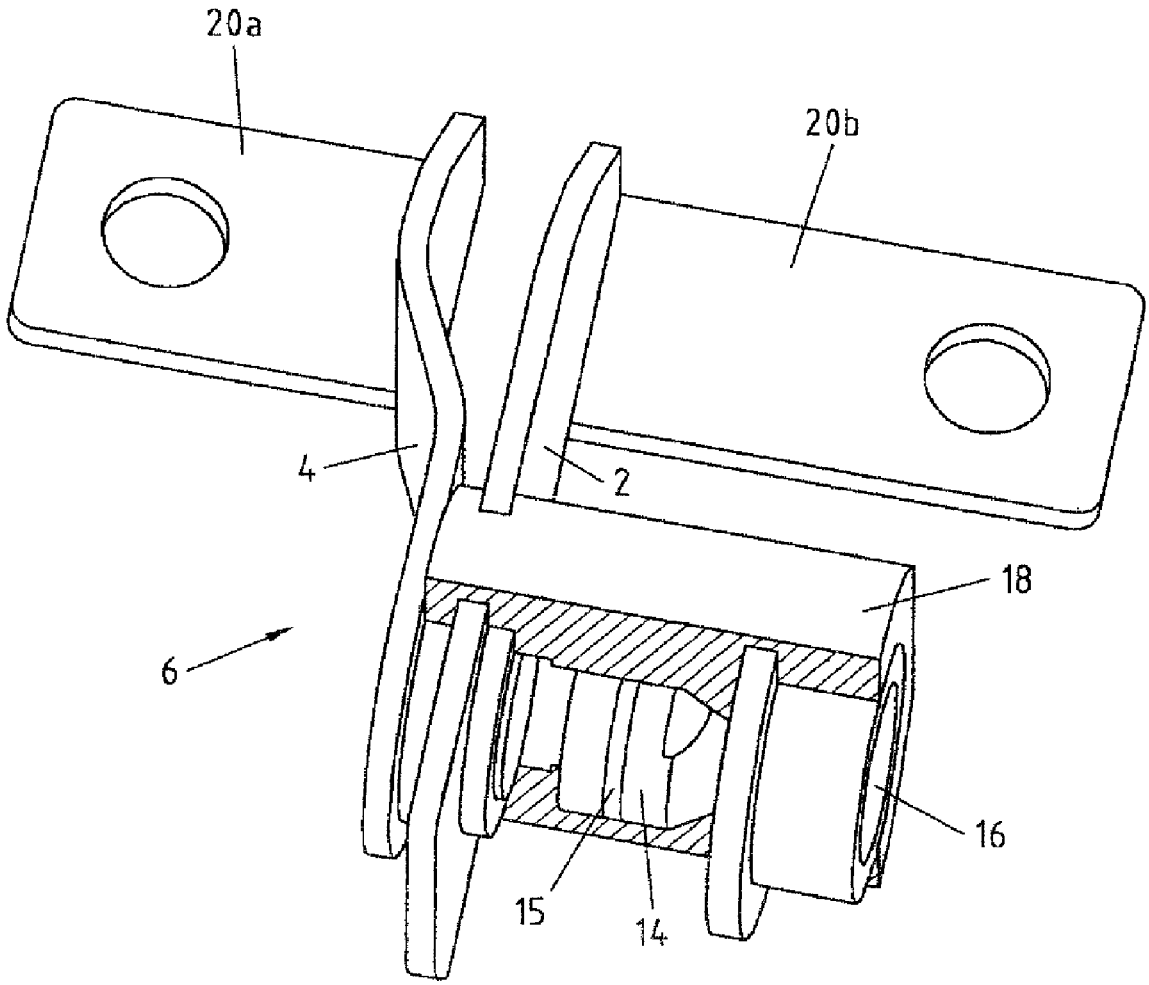
FIG. 4 a view of a circuit breaker with pyrotechnic separation unit.

FIG. 4 shows a circuit breaker 6 in assembled condition. The connection elements 2, 4 are joined together by means of a press connection. A pyrotechnic ignition unit 14 is arranged on the connection element 2. This pyrotechnic separation unit 14 can be sheathed by means of extrusion coating 18. In the embodiment shown, the extrusion coating 18 is cut open in order to display the pyrotechnic separation unit 14 better.

To trigger the pyrotechnic separation unit 14, an electrical connection to a plug socket 16 can be arranged. Using the pyrotechnic separation unit 14, by igniting the igniter a pressure can be built up in the cylinder space between igniter and projection which breaks the connection between the connection elements 2, 4. The separation unit 14 can be sealed using an O-ring 15. The effect of the seal is that there is no drop in gas pressure in the cylinder before the pot has been blasted out of the recess.

Connections 20*a*, 20*b* can be formed on the connection elements 2, 4 for attachment to a safety battery terminal. The connections 20 can be made in one piece with the connection elements 2, 4. Supporting structures may also be arranged on the connections 20 near the boreholes 20. The connections 20 allow attachment to battery pole terminals. This can secure the current path between a battery pole terminal and the vehicle system.

Figure 5A:
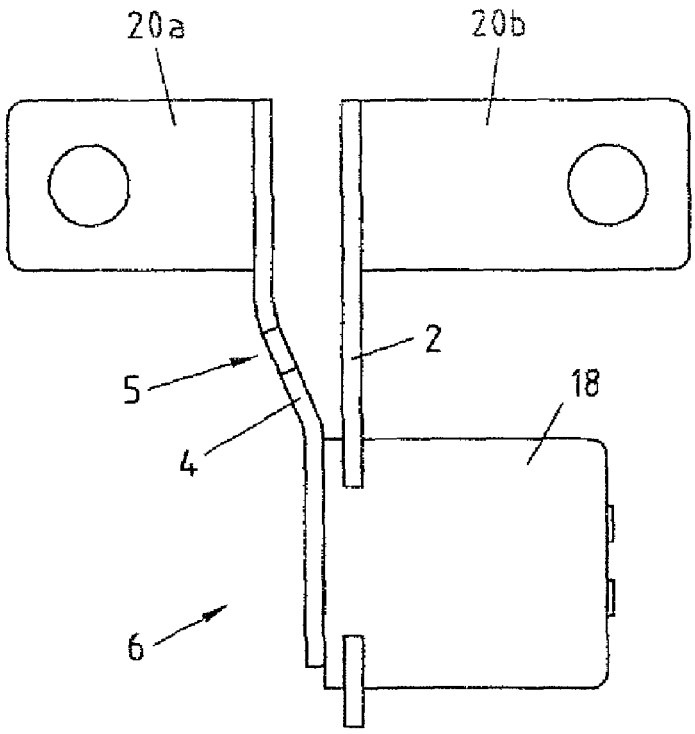
FIG. 5A a circuit breaker in conducting state before activation of the pyrotechnic separation unit.
Figure 5B:
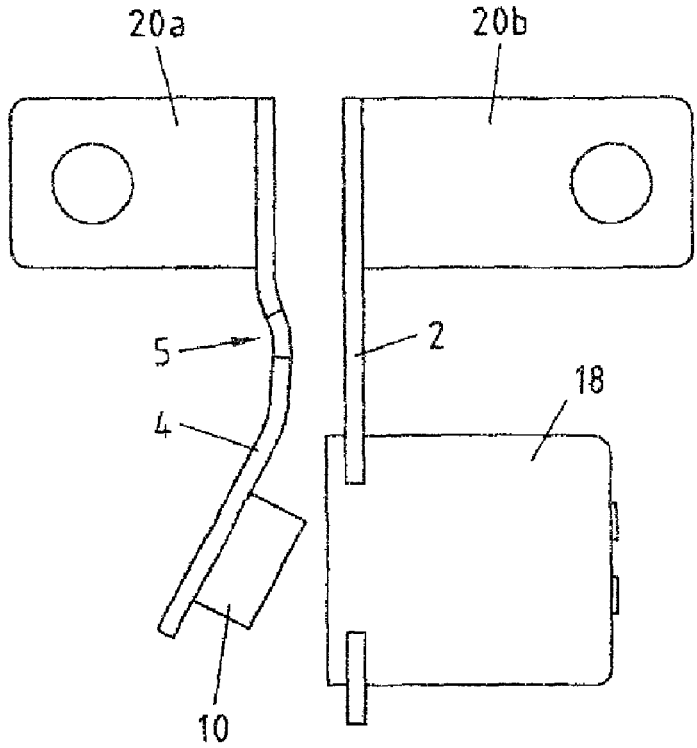
FIG. 5B a circuit breaker in separated state after activation of the pyrotechnic ignition unit.

FIG. 5A shows a circuit breaker 6 before activation of the pyrotechnic separation unit 14. The connection elements 2, 4 are electrically connected to each other. The pyrotechnic separation unit 14 is provided in the extrusion coating 18. A current flow can run from connection 20*a* via connection element 4, connection element 2 and connection 20*b*.

In the case of a major collision, for example a vehicle accident, the pyrotechnic separation unit 14 can be driven and the igniter ignited. The gas pressure created by the ignition of the igniter has the effect of pressing the projection 10 out of the recess 8 and separating the current path between connection element 2 and connection element 4. The constriction 5 thereby serves the purpose of simplifying the separation of the connection elements 2, 4. The connection element 2, 4 can be more easily bent along the constriction 5. Therefore a lesser force acts on the connection 20 at the time of ignition.

Figure 6:
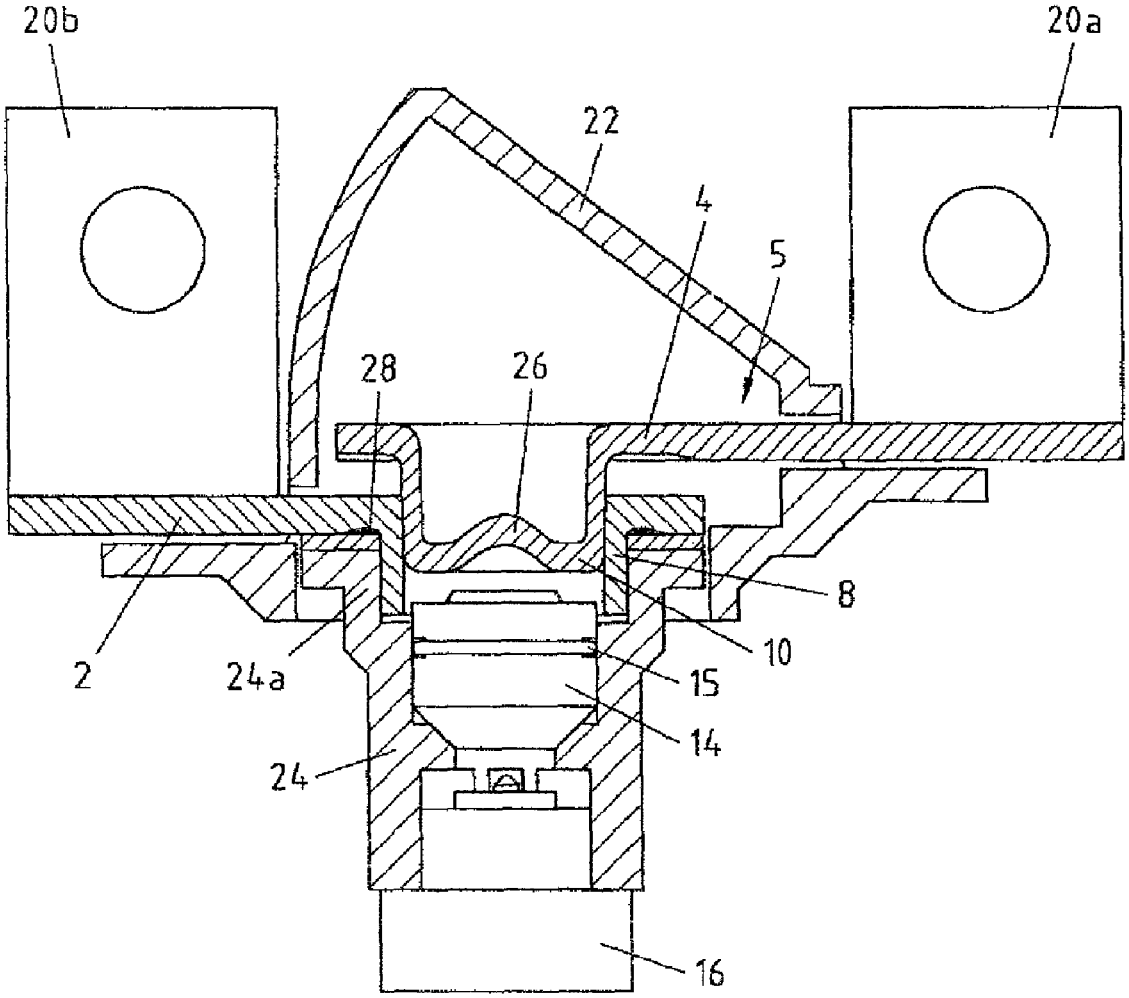
FIG. 6 a sectional view of a closed circuit breaker.

FIG. 6 shows a sectional view of a circuit breaker according to one embodiment. In addition to the previously described elements, the circuit breaker also has a safety housing 22. After ignition of the igniter 14, part of the connection element 4 is pivoted into this safety housing 22. The safety housing prevents the connection element 4 getting into the engine space.

A housing 24 seals off the igniter 14. A joining flange 24*a* can grip tightly around the collar 8 for this purpose. A seal 28 can be provided, preventing the gas escaping from the cylinder space following ignition of the igniter 14. The joining flange 24*a* of the housing 24 is pushed onto the collar 8 during assembly. The igniter 14 can be inserted into the housing 24 beforehand.

In order to make better use of the gas pressure in the cylinder space following ignition of the igniter for the separation of the connection elements 2, 4 from each other, the pot 10 can have a recess 26 in the direction of the cylinder space. A higher gas pressure can build up in this recess 26, which promotes the separation of the connection.

Figure 7:
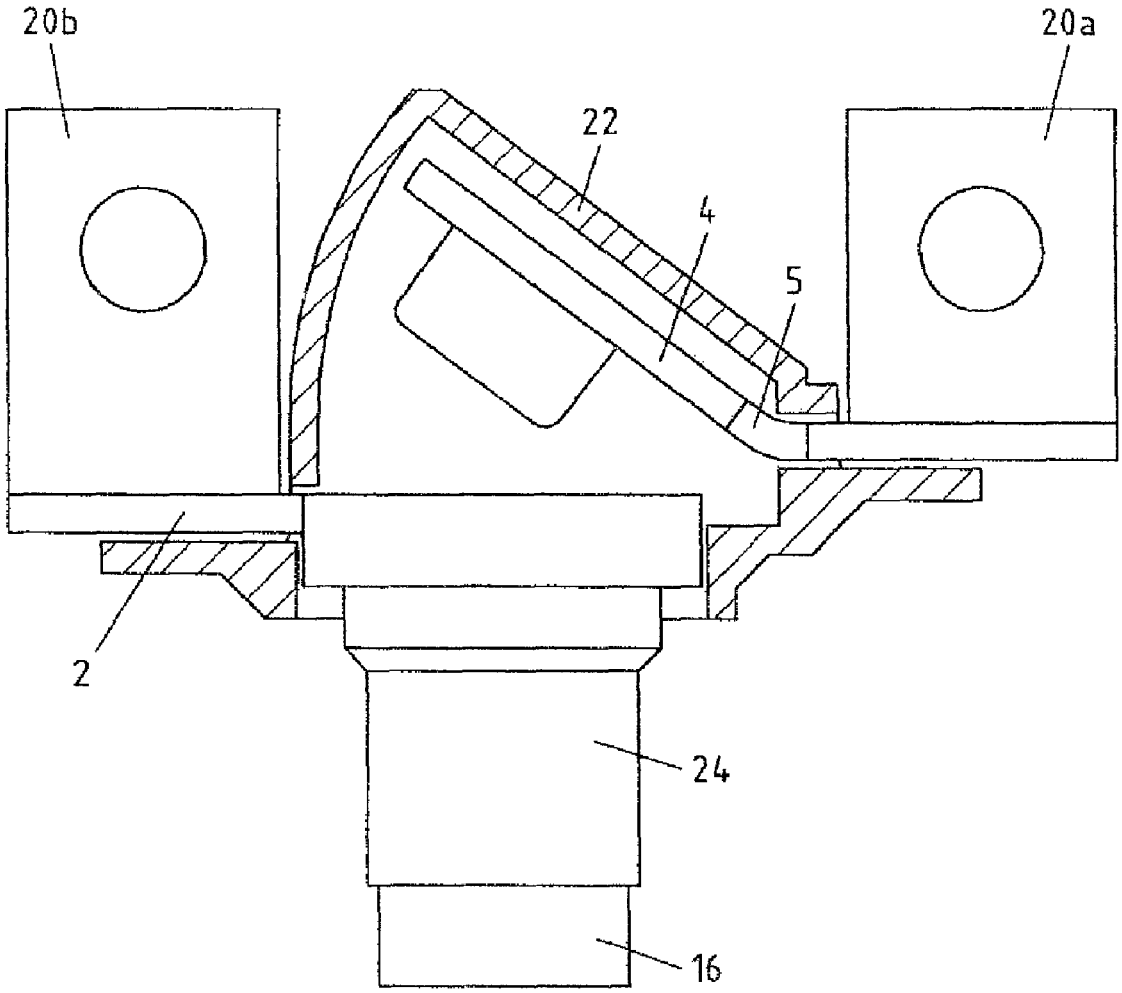
FIG. 7 a lateral view of an open circuit breaker.

FIG. 7 shows the circuit breaker according to FIG. 6 in open condition. Only the housing 24 is shown in a non-cut condition.

The inventive circuit breaker is characterised by economical and simple manufacture. Also, following activation of the pyrotechnic separation unit, the circuit breaker can be reassembled, so that there is no longer any need to replace components.

What is claimed is:

1. A circuit breaker for electrical power leads, the circuit breaker comprising:

a first connection element; and a second connection element, wherein when the circuit breaker is in a conducting state, a current path runs between the first connection element and the second connection element;

wherein the first connection element is formed from an electrically-conductive flat part, a recess is formed in the flat part of the first connection element;

the second connection element is formed from an electrically-conductive flat part; and wherein a projection corresponding with the recess is formed on the flat part of the second connection element in such a way that when the circuit breaker is in a conducting state the projection is locked in the recess frictionally.

2. The circuit breaker of claim 1, wherein the recess is stamped out of the flat part of the first connection element.

3. The circuit breaker of claim 1, wherein the projection is formed in a single piece out of the flat part of the second connection element.

4. The circuit breaker of claim 1, wherein at least one flat part is produced from a sheet of metal.

5. The circuit breaker of claim 4, wherein at least one flat part is produced from a sheet of metal by means of a cutting process.

6. The circuit breaker of claim 1, wherein the recess has a collar.

7. The circuit breaker of claim 6, wherein a separating member is provided on the first connection element, in such a way that the recess of the first connection element and the projection of second connection element are separated by the separating member.

8. The circuit breaker of claim 7, wherein a pin is accelerated in the direction of the projection by means of the separating member in such a way that the recess of the first connection element and the projection of the second connection element are separated.

9. The circuit breaker of claim 1, wherein the projection is drawn out of the flat part of the second connection element.

10. The circuit breaker of claim 9, wherein the projection is a deep-drawn pot corresponding with the recess.

11. The circuit breaker of claim 9, wherein the projection tapers in the direction extending from the flat part of the second connection element.

12. The circuit breaker of claim 9, wherein the projection is drawn out of the flat part of the second connection element during a joining of the first connection element to the second connection element.

13. The circuit breaker of claim 9, wherein after a joining of the first connection element to the second connection element, the projection forms a conical press fit with the recess.

* * * * *